United States Patent [19]

Cornelius et al.

[11] 4,187,910

[45] Feb. 12, 1980

[54] $CO_2$ REMOVAL FROM HYDROCARBON GAS IN WATER BEARING UNDERGROUND RESERVOIR

[75] Inventors: Archie J. Cornelius; Riley B. Needham, both of Bartlesville, Okla.

[73] Assignee: Phillips Petroleum Company, Bartlesville, Okla.

[21] Appl. No.: 893,364

[22] Filed: Apr. 4, 1978

[51] Int. Cl.[2] ..... E21B 43/00

[52] U.S. Cl. ..... 166/305 R; 166/263; 166/268

[58] Field of Search ..... 166/258, 263, 266, 267, 166/268, 269, 305 R; 55/1, 68

[56] References Cited

U.S. PATENT DOCUMENTS

| | | | |
|---|---|---|---|
| 2,723,001 | 11/1955 | Hoff | 55/68 X |
| 2,729,291 | 1/1956 | Haverfield | 166/266 |
| 2,875,832 | 3/1959 | Martin et al. | 166/266 |
| 3,072,187 | 1/1963 | Carr | 166/258 |
| 3,075,918 | 1/1963 | Holm | 55/68 X |
| 3,097,917 | 7/1963 | Dotts, Jr. et al. | 55/68 X |
| 3,283,818 | 11/1966 | Santourian | 166/305 R |
| 3,323,593 | 6/1967 | Foshee et al. | 55/68 |
| 3,823,777 | 7/1974 | Allen | 166/266 |
| 3,871,451 | 3/1975 | Brown | 166/267 |
| 3,995,693 | 12/1976 | Cornelius | 166/268 |
| 4,108,244 | 8/1978 | Cook et al. | 166/268 |

OTHER PUBLICATIONS

Muskat, M., *Physical Principles of Oil Production*, First Edition, McGraw-Hill, 1949, p. 105.

*Primary Examiner*—Stephen J. Novosad
*Assistant Examiner*—George A. Suchfield

[57] ABSTRACT

A process for decreasing the $CO_2$ content of hydrocarbon gas by injecting a hydrocarbon gas containing $CO_2$ into a water bearing zone of an underground formation and producing hydrocarbon gas from a collection point in the underground formation removed from the injection point.

8 Claims, 1 Drawing Figure

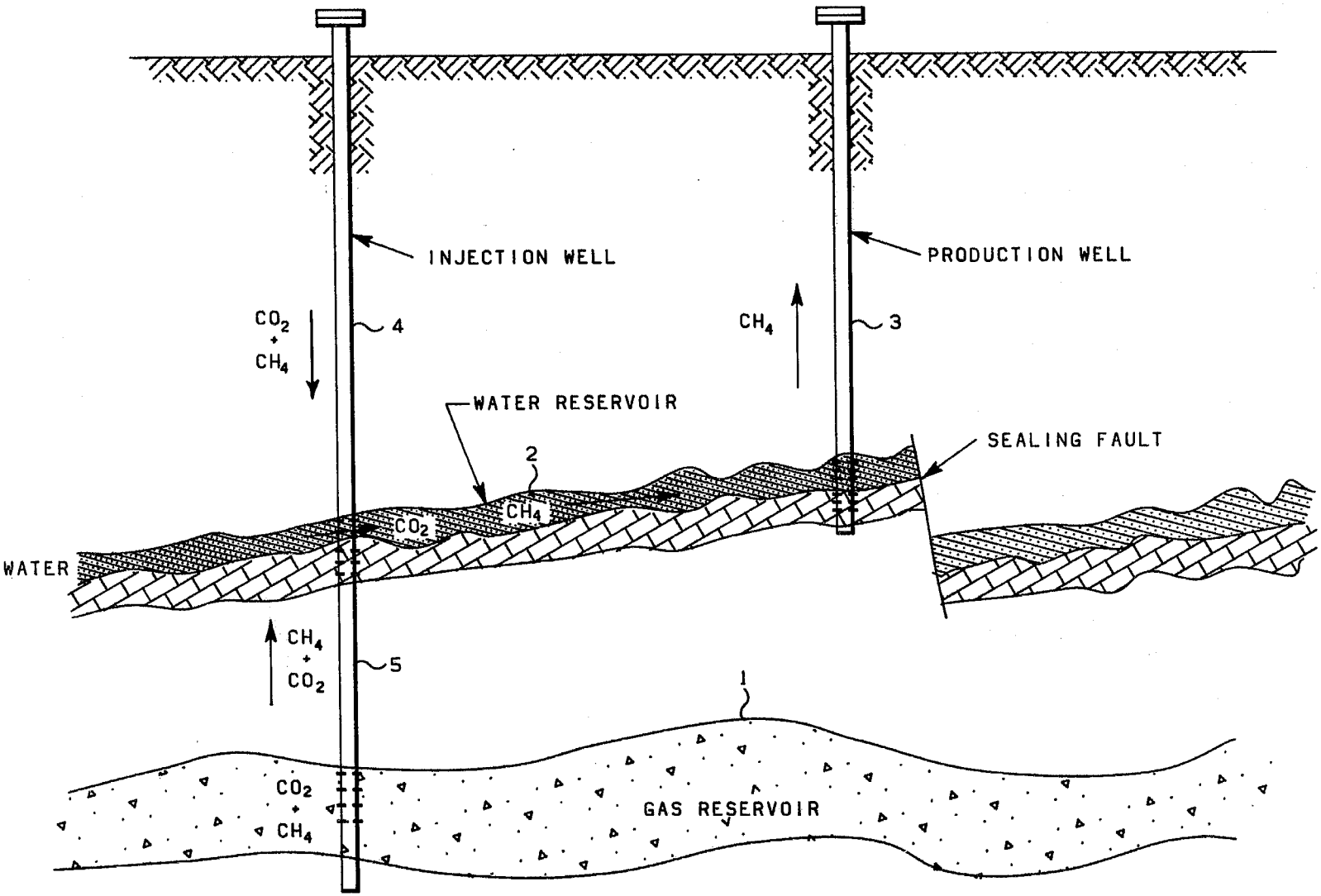
PRODUCTION WELL
SEALING FAULT
3
$CH_4$
INJECTION WELL
WATER RESERVOIR
2
$CH_4$
$CO_2$
4
5
$CO_2$ + $CH_4$
$CH_4$ + $CO_2$
1
GAS RESERVOIR
$CO_2$ + $CH_4$
WATER

$CO_2$ REMOVAL FROM HYDROCARBON GAS IN WATER BEARING UNDERGROUND RESERVOIR

BACKGROUND OF THE INVENTION

This invention relates to the treatment of hydrocarbon gas. In one of its aspects this invention relates to a method for reducing the $CO_2$ content of a hydrocarbon gas-$CO_2$ mixture to produce hydrocarbon gas having a sufficient BTU content for use as fuel. In another of its aspects this invention relates to a method for separating $CO_2$ and hydrocarbon gas from a mixture thereof. In yet another of its aspects this invention relates to the recovering of a $CO_2$ enriched product gas from a $CO_2$-hydrocarbon gas mixture.

Hydrocarbon gas streams are produced from underground formations with the hydrocarbon gas containing $CO_2$ in amounts from a trace up to about 98% of the total. A hydrocarbon gas containing carbon dioxide may be the natural product from the formation or the mixture of hydrocarbon gas and $CO_2$ can be the product of improved oil recovery projects in which $CO_2$ is injected into a reservoir to displace oil. While relatively small amounts of $CO_2$ in a hydrocarbon gas stream are not harmful, relatively large amounts of $CO_2$ sufficiently reduce the BTU content of the mixture so that it is not useful as a fuel gas.

It is therefore an object of this invention to provide a method for treating a mixture of hydrocarbon gas and carbon dioxide sufficiently to reduce the $CO_2$ content to provide a resulting mixture that is useful as a fuel. It is another object of this invention to provide a method for separating hydrocarbon gas from a mixture of hydrocarbon gas and carbon dioxide to produce a stream of increased carbon dioxide content.

Other aspects, objects, and the various advantages of this invention will become apparent upon reading the specification and the appended claims.

STATEMENT OF THE INVENTION

In accordance with this invention, a method is provided for decreasing the $CO_2$ content of hydrocarbon gas. A hydrocarbon gas containing $CO_2$ is injected into a water bearing zone of an underground formation and hydrocarbon gas containing a reduced amount of $CO_2$ is produced from a portion of the underground formation sufficiently removed from the injection point so that $CO_2$ is allowed to dissolve in the water.

In an embodiment of the invention, a method is provided for periodically backflowing the well into which the mixture of hydrocarbon gas and carbon dioxide is injected to produce a mixture of hydrocarbon gas and carbon dioxide that is richer in carbon dioxide than the gas mixture originally injected.

The process of this invention depends on the dissolving of carbon dioxide from the mixture of hydrocarbon gas and carbon dioxide into water in an underground formation. The amount of carbon dioxide dissolved, because of relatively greater solubility in the water, will be greater than the hydrocarbon gases absorbed.

This method for removing carbon dioxide from hydrocarbon gases should be applicable to any reservoir in which water bearing zones naturally occur. It should be particularly applicable in an underground formation having a water zone in which there is movement of the water to carry the dissolved $CO_2$ away from the contacting zone. The process is equally suitable in underground formations where water flooding techniques have been practiced.

The process of this invention is carried out at pressures ranging from above atmospheric up to a pressure that adversely affects dissolving of carbon dioxide in water. A pressure in a range up to about 10,000 psia, preferably up to about 5,000 psia, is useful for operation of the invention.

During the injection of natural gas and carbon dioxide into the underground reservoir, the hydrocarbon gas from which at least some of the carbon dioxide has been absorbed tends to collect in the upper permeable region of the reservoir. The hydrocarbon gas depleted in carbon dioxide content can be collected from a production well other than the well used for injecting gaseous mixture. By monitoring the carbon dioxide content of the hydrocarbon gas, a salable product can be produced as long as the carbon dioxide content is below that tolerable in salable hydrocarbon gas. Once the toleration limit is reached for the carbon dioxide content, the mixture of hydrocarbon gas and carbon dioxide can be collected from the reservoir and pumped to another reservoir containing a water bearing zone using the method of this invention to again reduce the carbon dioxide content of the injected mixture to produce a salable hydrocarbon gas product.

It has also been found that by reducing the pressure at the injection well and backflowing reservoir material from the injection well a gas of higher carbon dioxide content than that originally injected can be produced. Upon reduction of pressure for backflowing carbon dioxide tends to come out of solution from the water to produce a gas stream enriched in carbon dioxide.

As stated before, the process is compatible with water flooding techniques. It is also compatible with the various methods known for creating permanent and temporary blockages in the more permeable portions of underground formations such as by creating blockages with foams and gels.

The operation of the invention can be better understood by illustration for the following example. The example is meant to be illustrative only and should not be taken as restrictive.

Reference to the drawing, which is a representation of an underground formation containing a water reservoir, is made to illustrate the operation of this invention. Gas reservoir 1, containing $CO_2$-rich natural gas, is located below structure 2, which contains a large water reservoir. Gas reservoirs are frequently so located and, when the gas is rich in $CO_2$ are advantageously treated according to this invention. Well 4 is drilled through the water formation 2 and extended as 5 into the $CO_2$-rich gas reservoir 1. Gas is then passed through well 5 and injected into water reservoir 2 without being brought to the surface. As the gas passes through water reservoir 2 on the way to production well 3, most of the $CO_2$ in the gas is absorbed by the water.

If no water reservoir is available above a gas formation containing $CO_2$-rich gas, the gas is brought to the surface and injected into an available water reservoir, for example through injection well 4 into reservoir 2 in the drawing.

As a specific illustration of our invention, natural gas containing 71 volume percent $CO_2$ is injected at a rate of 50 million standard cubic feet (SCF) per day into the near bottom of a water reservoir at a depth of 3500 feet. Water reservoir temperature is 122° F. (49° C.) and pressure is 1400 psia. The gas may be injected into the water from a source above the ground or from a gas reservoir below the water reservoir without first having been produced aboveground, as illustrated in the drawing. At a distance of 5000 feet from the injection well, a production well is drilled to the approximate top of the structure of the water reservoir.

The $CO_2$-rich gas is injected into the formation for a period of fourteen days before production is begun from the producer well. Production may be delayed longer or it may start sooner, depending on the methane content of the gas produced from the well. Continuous production is begun when the methane content of the gas produced is analyzed to be approximately a desired value, for example, 95 volume percent. Production rate is then adjusted from the producer well to maintain the production of gas containing approximately 95+ volume percent methane. As the methane content of the produced gas decreases, the production rate is decreased to provide a longer contacting time for the gas in the water formation thereby increasing the amount of $CO_2$ absorbed by the water and reducing the $CO_2$ content of the produced gas. Total production from the producer well is normally kept about equal to the injection rate of methane in order to maintain pressure in the reservoir. As the production rate is decreased, the injection rate will also be decreased.

As the water reservoir approaches saturation with $CO_2$, the produced gas will necessarily contain higher concentrations of $CO_2$ despite reduced production rates. The decrease of production rates to uneconomically low hydrocarbon gas content values would require that gas injection be stopped. Production of gas from the water reservoir is continued and the pressure in the reservoir is allowed to decrease. The $CO_2$ comes out of solution from the water at the lower pressure and a gas with a high $CO_2$ concentration, in some cases nearly pure $CO_2$, can be produced from either the injection well or the production well (or both). This high purity $CO_2$ gas finds numerous applications, such as in the production of dry ice or in the flooding of an oil reservoir with $CO_2$.

The life of a water reservoir for absorbing $CO_2$ from a $CO_2$-rich natural gas depends, of course, on the amount of water in the reservoir, whether the water is stagnant or flowing from nearby formations, and the amount of carbon dioxide desired to be removed. Under a pressure of 1000 psia or higher, as likely encountered in an underground water formation, the solubility of $CO_2$ in water can be as high as 125 standard cubic feet per barrel of water, so that an underground formation containing 150,000,000 barrels of water can have the capacity for absorbing 20 billion cubic feet of $CO_2$, measured at standard conditions (herewith is incorporated by reference, "$CO_2$ Requirements in $CO_2$ Slug and Carbonated $H_2O$ Oil Recovery Processes", *Producers Monthly,* September, 1963, pp. 6–28, in which $CO_2$ solubility in $H_2O$ is discussed). Such a reservoir can reduce the carbon dioxide concentration of about 30 billion cubic feet of natural gas from 75 to 5 volume percent. Assuming an injection rate of 50 million cubic feet per day, the water in a stagnant reservoir could remove $CO_2$ for 365 days before becoming saturated. Water flowing into and out of the reservoir prolongs its life as a $CO_2$ absorber. The flow can be sufficient to allow use of a reservoir for $CO_2$ absorption for an indefinite period.

It is preferred that the water reservoir be about 1000 feet in thickness to serve as a $CO_2$ absorber. Such a reservoir with 30 percent porosity and with 100 percent water saturation contains 150 million barrels of water per 65 acres. Such a reservoir covering one section of land, or 640 acres, contains 1.5 billion barrels of water and would, in terms of this example, have a 10-year life for the removal of $CO_2$.

We claim:

1. A method for decreasing the $CO_2$ content of hydrocarbon gas, said method comprising:

(1) injecting hydrocarbon gas containing $CO_2$ into a water bearing zone of an underground formation, (2) dissolving $CO_2$ in the water zone, (3) collecting $CO_2$-depleted hydrocarbon gas in another permeable portion of the formation, and (4) producing hydrocarbon gas reduced in $CO_2$ content from said other permeable portions of the formation.

2. A method of claim 1 wherein upon reaching in the hydrocarbon gas produced from the reservoir the maximum carbon dioxide content tolerable in fuel gas (a) pressure is reduced at the injection well and (b) a backflow gas is produced at the injection well, said backflow having a higher $CO_2$ content than the gas that has been injected.

3. A method of claim 1 comprising periodically reducing the pressure of the injection well and backflowing a gas higher in $CO_2$ content than that originally injected.

4. A method of claim 3 wherein said backflow gas is collected for use.

5. A method of claim 1 wherein the mixture of hydrocarbon gas and carbon dioxide injected into the reservoir was produced from carbon dioxide treatment of a reservoir system.

6. A method of claim 1 wherein said hydrocarbon gas containing carbon dioxide produced from the reservoir is collected for use.

7. A method of claim 1 wherein hydrocarbon gas containing $CO_2$ is injected from above ground into said water bearing zone.

8. A method of claim 7 wherein hydrocarbon gas containing $CO_2$ is injected into said water bearing zone from a gas reservoir underground without having been first produced above ground.

* * * * *

UNITED STATES PATENT AND TRADEMARK OFFICE

CERTIFICATE OF CORRECTION

PATENT NO. : 4,187,910

DATED : February 12, 1980

INVENTOR(S) : Archie J. Cornelius and Riley B. Needham

It is certified that error appears in the above-identified patent and that said Letters Patent are hereby corrected as shown below:

Column 4, line 53, "7" should be --- 1 ---.

Signed and Sealed this

*Seventeenth* Day of *June 1980*

[SEAL]

*Attest:*

SIDNEY A. DIAMOND

*Attesting Officer*

*Commissioner of Patents and Trademarks*